US005484494A

United States Patent [19]

Oda et al.

[11] Patent Number: 5,484,494

[45] Date of Patent: Jan. 16, 1996

[54] AMORPHOUS ALLOY AND METHOD FOR ITS PRODUCTION

[75] Inventors: Masaharu Oda; Kensuke Kamada; Takatoshi Kubo, all of Otake, Japan

[73] Assignee: Mitsubishi Rayon Company, Inc., Tokyo, Japan

[21] Appl. No.: 331,549

[22] Filed: Nov. 14, 1994

[30] Foreign Application Priority Data

May 14, 1992 [JP] Japan ..... 4-122219

[51] Int. Cl.[6] ..... C25D 3/56; C22C 45/04

[52] U.S. Cl. ..... 148/561; 205/77; 205/258

[58] Field of Search ..... 148/304, 313, 148/403, 561; 205/77, 258

[56] References Cited

U.S. PATENT DOCUMENTS

| | | | |
|---|---|---|---|
| 2,927,889 | 3/1960 | Clinehens | 205/77 |
| 4,101,389 | 7/1978 | Uedaira . | |
| 4,152,144 | 5/1979 | Hasegawa et al. | 148/403 |
| 4,187,128 | 2/1980 | Billings et al. | 148/304 |
| 4,668,310 | 5/1987 | Kudo et al. | 148/304 |
| 5,096,513 | 3/1992 | Sawa et al. | 148/313 |

FOREIGN PATENT DOCUMENTS

| | | |
|---|---|---|
| 422760 | 4/1991 | European Pat. Off. . |
| 52-140403 | 11/1977 | Japan . |
| 55-164092 | 12/1980 | Japan . |
| 60-33382 | 2/1985 | Japan . |
| 63-10235 | 1/1988 | Japan . |

OTHER PUBLICATIONS

"Very Low Loss Ultrathin Co–Based Amorphous Ribbon Cores", M. Yagi; *J. Appl. Phys.*, 64(10), Nov. 15, 1988, pp. 6050–6052.

"Metallic Glasses", E. M. Gyorgy; *American Society for Metals*, pp. 275–303 (1978).

"On Amorphous Metals and Applications of Fine Met", K. Yamauchi, *'89 Switching Power Source System Symposium*, Mar. 2, 1989, pp. 5–2–1 to 5–2–7.

"Ferroxpoana*), Hexagonal Ferromagnetic Iron–Oxide Compounds for Very High Frequencies", G. H. Jonker, *Phillips Technical Review*, vol. 18, 1956/57, No. 6, pp. 145–154.

*Primary Examiner*—George Wyszomierski

*Attorney, Agent, or Firm*—Oblon, Spivak, McClelland, Maier & Neustadt

[57] ABSTRACT

An amorphous alloy which has a composition represented by the general formula $(Fe_{1-a}\ Co_a)_{1-x-y-z}\ P_x\ W_y\ M_z$ (where $0.9 \leqq a$, $0.04 \leqq x \leqq 0.16$, $0.005 \leqq y \leqq 0.05$, $0 \leqq z \leqq 0.2$, and M is one or more transition elements other than Fe, Co, and W. In a method for producing the amorphous alloy comprising at least Fe, Co, P and W by electrodeposition, the electrodeposition is performed in an acidic electrolyte bath which employs phosphorous acid and/or a phosphite as the P source and sodium tungstate as the W source, or in an acidic electrolyte bath which employs sodium phosphotungstate as the P and W source. The amorphous alloy which contains phosphorous as the metalloid element exhibits little reduction in saturation magnetization, and the crystallization temperature may be increased to above 450° C.

2 Claims, 2 Drawing Sheets

AMORPHOUS ALLOY AND METHOD FOR ITS PRODUCTION

FIELD OF THE INVENTION

The present invention relates to an amorphous alloy with excellent magnetic properties, especially soft magnetism, and excellent thermal resistance, to be used in magnetic heads and the like, as well as to a method for its production.

BACKGROUND ART

Amorphous alloys lack long periodicity because of the irregular orientation of their metal atoms, and they are structurally unique in comparison with crystalline alloys, in that they have no crystal grain boundary or lattice defects. Because of this, amorphous alloys have excellent magnetic properties. They are particularly promising in applications as low hysteresis loss materials and high permeable magnetic materials. For example, Fe-based amorphous alloys have a high saturation density, and their application has been considered in iron cores for transmitters, making use of their properties of low hysteresis loss. They are said to have a much reduced loss, and thus lower costs, in comparison with conventional silicon steel lamination. Also, Co-based amorphous alloys have a lower magnetic coercive force over a wide frequency range, and are used as magnetic cores for magnetic amplifiers and the like.

In the case of magnetic recording, high density recording is requirement for 8 mm VTRs (video tape recorders), high vision VTRs, etc. In order to achieve such high density recording, it is necessary not only to improve the magnetic tape, but also the magnetic head. The magnetic head material must have a high magnetic flux density at high frequencies. For this reason, various constructions of magnetic heads have been devised. For example, in MIG (metal in gap) type magnetic heads, the portion near the magnetic gap of a ferrite yoke is sharpened for concentration of the magnetic flux on the recording/reproducing surface, and a magnetic layer with a high magnetic permeability and a high magnetic flux density is provided on the tip thereof, to thus improve the sensitivity of the recording and reproduction. The use of amorphous alloys in such magnetic layers promises advantages for the reasons mentioned above.

The most commonly used method for producing amorphous alloys is quenching. This is a method of forming an amorphous alloy by feeding molten metal to a cooled revolving roller and then rapidly cooling it by $10^5$–$10^6$ deg/s to harden it without allowing time for crystallization. However, amorphous alloys produced by quenching presently have a minimum thickness of a few dozen μm or more. This is because irregularities occur on the surface of the molten metal when it is contacted with the cooling roller, making it difficult to form a thin film. The shape thereof is tape-like or filamentous. When used in a magnetic head or the like, it must be cut off and pasted onto the magnetic head yoke, but this involves a number of technical difficulties, including not only the strength and durability with the adhesive surface, but also the magnetic gap produced by the thickness and adhesive surface of the amorphous alloy. For this reason, amorphous alloys made by quenching is not applied to magnetic heads.

Other methods of producing amorphous alloys which have been studied include the sputtering, vacuum deposition and ion plating methods. Their application to magnetic heads has also been considered. However, the slow deposition rate of these methods renders their productivity poor and one must use special equipment which requires a large investment for facilities. These methods prevent low-cost mass production.

On the other hand, methods of producing amorphous alloys using electrolytic plating or non-electrolytic plating have also been studied (U.S. Pat. 4,101,389, Japanese Unexamined Patent Application SHO 55-164092, European Patent Specification NO. 422,760).

Plating methods make it possible to form amorphous alloys with satisfactory adherence to the magnetic head yoke. In addition, the equipment is simpler and productivity is higher, making these methods more suitable for the production of magnetic heads.

Nevertheless, in plating methods there are a limited number of metalloid elements which allow a stable amorphous state. Plating methods require salts of metalloid elements that are soluble in solvents (generally water). The metalloid elements include silicon, carbon, boron and phosphorus, but there are no appropriate water-soluble salts containing salts of silicon and carbon, and although water-soluble salts of boron exist, their oxidation-reduction potential is very undesirable compared to that of the transition elements such as iron, cobalt and the like, and thus it is difficult to obtain a eutectic mixture thereof.

For such reasons, phosphorus is usually used as the metalloid element in plating methods, as may be seen in the above-mentioned European Patent Specification No. 422,760 and U.S. Pat. No. 4,101,389. The donor salt which provides the phosphorus for the amorphous alloy may be phosphorous acid or a salt thereof, or hypophosphorous acid or a salt thereof, and they may easily form alloys with the transition metals.

FIG. 1 shows the crystallization temperature of phosphorus-containing amorphous alloys plotted against their content ratios. In the case of alloys with low phosphorus contents, two thermal peaks due to crystallization are observed, while in the case of those with high phosphorus contents there is only a single one near 350° C. However, the crystallization temperature does not rise even if the phosphorus content is further increased.

Incidentally, in the case of magnetic heads as mentioned above, glass is fused in the gap of the sharpened recording/reproduction surface of the ferrite yoke. The glass used is one with a low melting point, but still temperatures of at least 450° C. are needed. If phosphorus is used as the metalloid element for plating, then the crystallization temperature of the alloy is as low as 350° C., and thus at 450° C. or greater crystallization of the alloy occurs, thus causing deterioration of the magnetic properties of magnetic head. While plating offers excellent industrial advantages, problems still remain in the production of magnetic heads.

On the other hand, amorphous alloys produced by methods other than plating contain large amounts of the metalloids silicon, boron, phosphorus and carbon (normally 20 atomic or more), for elevation of the crystallization temperature. Alternatively, 4d metals or 5d metals are used instead of metalloids. However, these methods tend to reduce in the magnetic property of saturation flux density, and thus a large amount of the amorphous material becomes necessary.

Furthermore, when amorphous alloys are used in electronic devices they usually are required to have a high degree of reliability with long-term use. Amorphous alloys are said to be thermodynamically metastable, and are sometimes considered to have doubtful durability. Considering this, while the amorphous alloys produced by plating are not problematic within the temperature range of normal use, from the point of view of the above-mentioned durability, they presently do not offer satisfactory reliability.

DISCLOSURE OF THE INVENTION

The present inventors have conducted diligent research in light of the situation described above, and have completed the present invention on the discovery of a method for drastically increasing the crystallization temperature of amorphous alloys in which phosphorus is used as the metalloid, without lowering their saturation flux density.

Thus, the present invention provides an amorphous alloy which is characterized by an alloy composition including at least iron, cobalt, phosphorus and tungsten, which alloy composition is represented, in terms of atomic ratio, by the following general formula:

$$(Fe_{1-a}\,Co_a)_{1-x-y-z}\,P_x\,W_y\,M_z$$

where $0.9 \leqq a$ $0.04 \leqq x \leqq 0.16$ $0.005 \leqq y \leqq 0.05$ $0 \leqq z \leqq 0.2$ and M is one or more transition elements other than Fe, Co, and W.

The present invention also provides a method for producing an amorphous alloy characterized by electrodepositing an amorphous alloy in which at least the atomic ratio of iron and cobalt is 90% or more of cobalt, the phosphorus content is 4–16 atomic % and the tungsten content is 0.5–5 atomic %, wherein the electrolyte bath used contains divalent iron ion 0.01–0.2 mol/l divalent cobalt ion 0.1–2.0 mol/l phosphite ion 0.01–0.2 mol/l tungstate ion or phosphotungstate ion 0.005–0.1 mol/l, and the electrodeposition is performed at pH 1.0–2.2 current density 1–40 A/dm$^2$ bath temperature 20°–80° C.

BEST MODE FOR CARRYING OUT THE INVENTION

The amorphous alloy according to the present invention must have excellent soft magnetic properties. The soft magnetic properties, especially coercive force, of magnetic materials are largely dependent on the magnetostriction of the magnetic substance used. Iron-cobalt systems have a high saturation flux density, and those with cobalt at 90% or more ($0.9 \leqq a$) in terms of atomic ratio of the iron and cobalt exhibit extremely low magnetostriction. Particularly, since the magnetostriction constant is roughly zero with 94% cobalt, this atomic ratio is most preferred.

The metalloid of the amorphous alloy of the present invention is phosphorus. Other metalloids include silicon, carbon and boron, but as mentioned above phosphorus is the element most generally suited for the production of amorphous alloys by plating. Amorphization of the alloy is possible with a phosphorus content in the amorphous alloy of 4–16 at % ($0.04 \leqq x \leqq 0.16$), but 10–14 at % ($0.1 \leqq x \leqq 0.14$) is more preferable. Amorphization is difficult at lower than 4 at %, and at greater than 16 at %, partial crystallization of phosphorus alone-added alloy occurs at 350° C. even with introduction of tungsten, and this crystallization of alloy is accompanied by a reduction in the saturation flux density.

Figure 1:
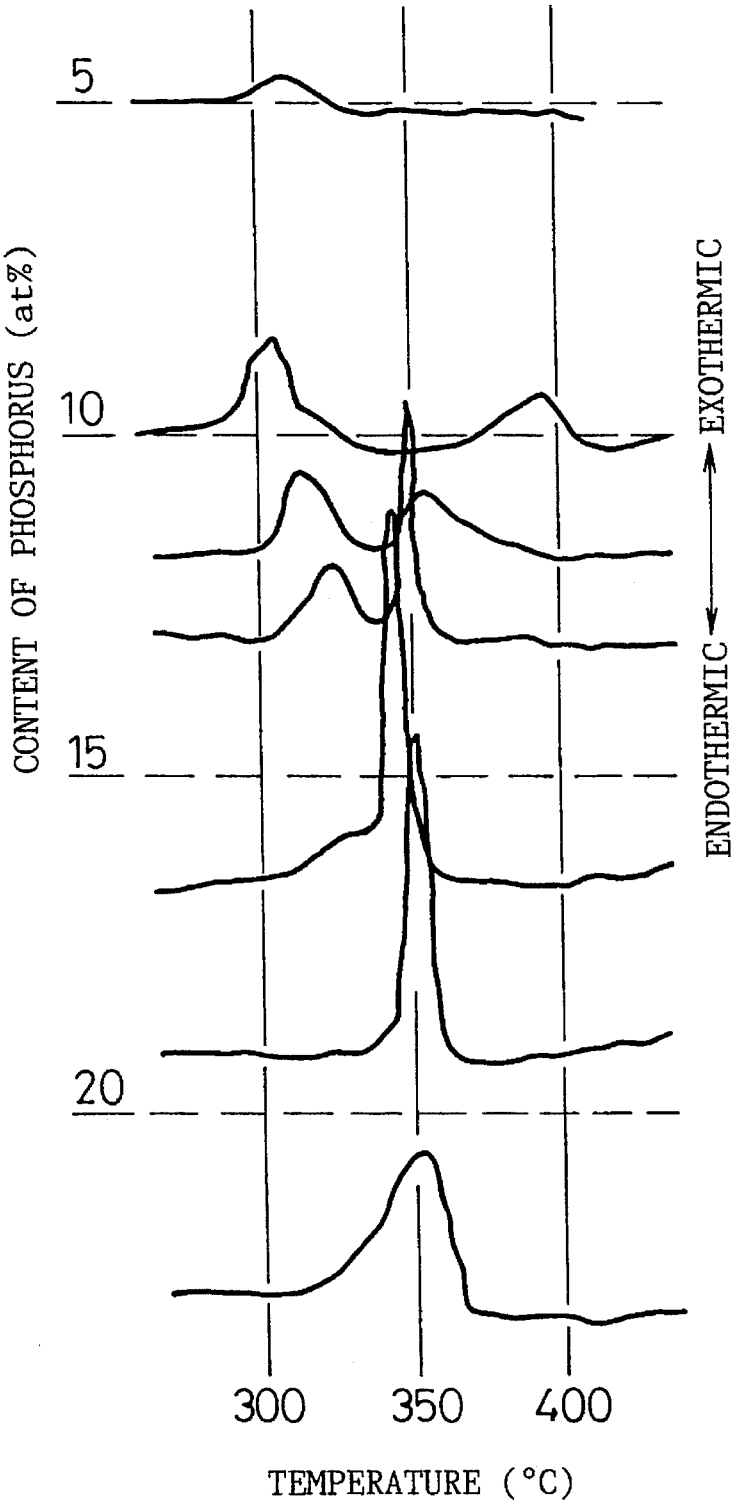
FIG. 1 is a differential thermal analysis (DSC) chart of alloys with different phosphorus contents.
Figure 2:
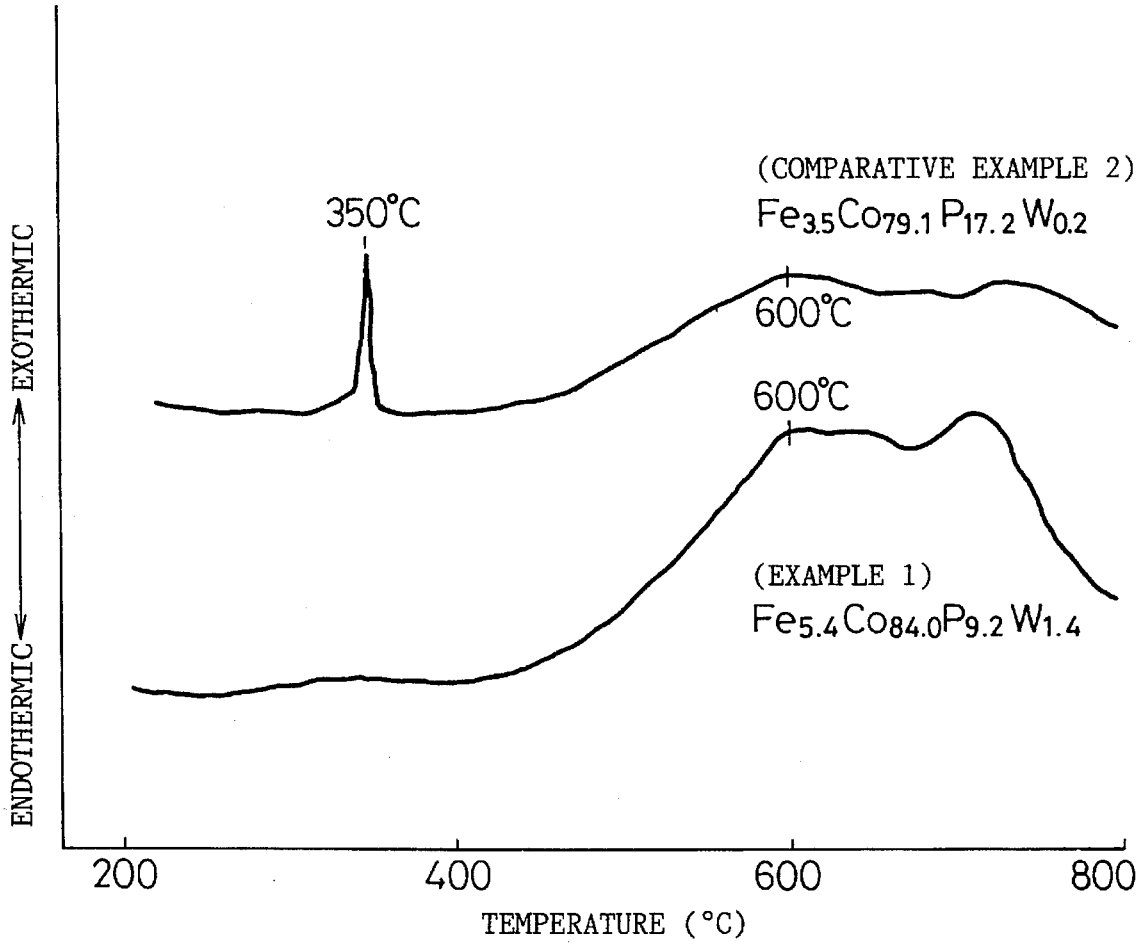
FIG. 2 is a differential thermal analysis (DTA) chart of alloys according to the present invention.

The amorphous alloy of the present invention is characterized in that the crystallization temperature is dramatically increased with a small amount of tungsten. The atomic radius of tungsten is larger than that of iron, cobalt or phosphorus, and is sufficient to interfere with the crystallization of iron and cobalt. However, alloys which contain some amount of tungsten are brittle, particularly lacking the ability to form thin films, and tend to have lower saturation flux densities. The present inventors have found that the crystallization temperature of an amorphous alloy is dramatically increased by adding the metalloid phosphorus and a small amount of tungsten. It is thus possible to raise the 350° C. crystallization temperature of the amorphous alloy with addition of phosphorus alone shown in FIG. 1, to 450° C. or higher, and even to 600° C. or higher. The tungsten content of the amorphous alloy is preferably 0.5–5 at % ($0.005 \leqq y \leqq 0.05$), and more preferably 0.6–1 at % ($0.006 \leqq y \leqq 0.01$). If the tungsten content is too low, then a large increase in the crystallization temperature cannot be expected, while if it is too high the alloy will be brittle. The present invention dramatically increases the crystallization temperature of amorphous alloy by addition of tungsten in such small amounts.

The fifth component, i.e. M in the above chemical formula (general formula), is a transition metal element which may be added if necessary depending on the use of the amorphous alloy. For example, for excellent corrosion resistance chromium, molybdenum or the like may be used, and for alloys requiring elongation, lead or the like may be used. The content of these elements is preferably in the range of 0–20 at % ($0 \leqq z \leqq 0.2$), since contents greater than this range lead to reduction in the conventionally demanded magnetic properties, particularly saturation flux density.

Thus, amorphous alloys with excellent heat resistance may be obtained, whose crystalline temperatures are 450° C. or greater, preferably 550° C. or greater, and more preferably 600° C. or more.

To obtain an amorphous alloy according to the present invention, any method including quenching, sputtering, high-vacuum metal deposition, ion plating, plating or the like may be used, and addition of a metalloid and a small amount of tungsten produces an amorphous alloy with a high crystallization temperature. Production by plating, i.e., electrolytic deposition, is most suitable from the point of view of industrial productivity and use application.

An iron-cobalt amorphous alloy with excellent soft magnetism which is produced by plating is already disclosed in European Patent Specification No. 422,760. The bath composition for electrolytic deposition in this case is an acidic plating bath comprising a divalent cobalt ion, a divalent iron ion and phosphorous acid and/or a salt thereof. Generally, iron group metal ions such as iron ion and cobalt ion are stable in acidic solutions, but precipitate as hydroxide compounds, etc. in alkaline solutions. In the above-mentioned European Patent Specification No. 422,760, the electrolytic deposition was performed stably in an acidic solution.

Tungstate ion is stable in alkaline solutions, but becomes tungstic acid in acidic solutions, producing a precipitate. In conventional plating of tungsten-containing alloys, plating is performed after iron or cobalt ion to is treated with a complexing agent to produce a stable complex ion of iron or cobalt in alkaline solutions.

The present inventors studied electrolytic deposition to obtain high-crystallization-temperature amorphous alloys in alkaline solutions using such methods, and found that it was difficult to obtain an amorphous alloy of the present invention.

It is known that tungstate ion is unstable in acidic solutions of hydrochloric acid, sulfuric acid and others. After avid research, the present inventors surprisingly discovered that it stably exists in an acidic solution of phosphorous acid, and the inventors accomplished the method of producing an amorphous alloy of the present invention.

Furthermore, if the sodium phosphotungstate is used, then electrolytic deposition is performed in the extremely stable plating bath. In this case, there is no precipitation of tungstic acid even if an acid other than phosphorous acid, such as hydrochloric acid or sulfuric acid, is used to adjust the pH during the plating. There has been no example in the past of such plating using a tungsten-containing alloy in an acidic solution.

The iron, cobalt and phosphorus constituting the amorphous alloy are supplied in the form of their salts, respectively.

The iron salt used may be ferrous sulfate, ferrous chloride, iron sulfamate, etc. or a mixture thereof.

The cobalt salt used may be cobalt sulfate, cobalt chloride, cobalt sulfamate, cobalt pyrophosphate, etc. or a mixture thereof.

The phosphorus may be supplied as phosphorous acid and/or phosphite, and a plating bath containing one or both of these is used. Specific examples of phosphites which may be used include phosphorous acid, potassium phosphite, ammonium hydrogen phosphite, sodium hydrogen phosphite, sodium phosphite, magnesium phosphite, and the like.

The tungsten source may be ammonium tungstate, tungstic acid, sodium tungstate, etc. or a mixture thereof.

Furthermore, for an amorphous alloy foil with good film formability, at least one reducing agent or complexing agent may be added. As a reducing agent there may be used hydroquinone, hydrazine, dimethylamine borane, sodium borohydride or the like, and as a complexing agent there may be used citric acid, hydroxycarboxylic acid, EDTA, gluconic acid or the like, The metal to be used as the work electrode may be iron, copper, brass, aluminum, stainless steel, ITO glass, etc. Also, to prevent progressive deterioration of the surface of the work electrode, even the magnetic head, it is preferable to coat the surface of the metal or alloy by hard chrome plating.

There are no particular restrictions on the shape of the work electrode, and in cases where an amorphous alloy thin-film is to be continuously produced, it is preferable to employ, for example, a drum shape or belt shape.

After the amorphous alloy is formed on the work electrode, an amorphous alloy thin-film can be easily obtained by delaminating it from the work electrode.

The electrolytic deposition conditions are:

$Fe^{2+}$ concentration: 0.01–0.2 mol/l $Co^{2+}$ concentration: 0.1–2.0 mol/l $PO_3^{3+}$ concentration: 0.01–0.2 mol/l $WO^2$ or $(PO_g\ 12WO_3)^{3-}$ concentration: 0.005–0.1 mol/l M ion concentration: 0–0.2 mol/l where in the case when sodium phosphotungstate is used, $PO_3^{3+}$ concentration is 0–0.2 mol/l.

If the ion concentrations in the plating bath are lower than these ranges, it will become difficult to form a plated film, and the condition of the formed film will also be poor. The ion concentrations higher than these ranges will result in poor dissolution of the ion salts in the plating solution.

The electrodeposition conditions are preferably as below:

pH: 1.0–2.2

Current density: 1–40 A/dm$^2$

Bath temperature: 20°–80° C.

If the pH falls outside of the above range to less than 1.0, there will be excess hydrogen generation at the work electrode. Thus the current efficiency will be reduced, and the film plating on the work electrode will be extremely poor. Also, if the pH exceeds 2.2, the current efficiency will be improved, but the phosphorus content of the alloy will be lowered, thus causing it difficult to obtain amorphization. If the current density is lower than the above range, the plating will be more difficult, and if it is higher then stress will accumulate on the plated film, causing cracks in extreme cases. If the bath temperature is lower than the above range, it will be difficult to form a film with excellent smooth surface, and if it is higher than the above range, precipitation will easily occur in the plating bath, making it more difficult to manage. The most preferred conditions are:

pH: 1.3–2.0

Current density: 3–20 A/dm$^2$

Bath temperature: 40°–60° C.

The composition of the deposited alloy may be controlled by varying the electrodeposition bath composition, the pH and the current density.

According to this type of plating method it is possible to obtain an amorphous alloy in the form of tape or foil, and specifically it is possible to obtain such amorphous alloys in the form of tape or foil with thicknesses of 20 pm or less, and even thicknesses of 10 μm or less, 5 μm or less and 2 μm or less, and with the advantage of being a thin film by which eddycurrent, which causes magnetic loss at high frequencies is lowered. In addition, by smoothing the surface of the working electrode, the surface of the amorphous alloy thin film may be smoothed very much to prevent reduction in the magnetic properties due to pinning of the magnetic wall.

EXAMPLES

Example 1

A mixed solution with concentrations of 0.1 mol/l ferrous chloride and 0.9 mol/l cobalt sulfate was adjusted to pH 1.0 using a 1.0 mol/l phosphorous acid solution. To 500 cc of this solution there was added 50 cc of a 0.5 mol/l sodium tungstate solution, and the mixture was stirred and allowed to stand. Its condition was observed visually.

The result was that a white precipitate was produced at the moment the sodium tungstate solution was added, and this precipitate disappeared upon stirring, after which no precipitate was produced. The solution was stable even after storage for one week. Since a pH increase was observed for this solution by the addition of the sodium tungstate solution, the above-mentioned phosphorous acid solution was also added to adjust the pH to 1.8. Using this solution as the electrolyte solution, cobalt as the opposing electrode and mirror finished stainless steel with an center line average of 0.1 μm as the work electrode, a voltage corresponding to a current density of 5 A/dm$^2$ was applied between the two electrodes to deposit an amorphous iron-cobalt-tungsten-phosphorus alloy. The plating time was 6 minutes, and the plated film was peeled off from the electrode and subjected to the analysis described below.

The amorphism was determined by the presence of crystal-based reflection upon X-ray diffraction. The composition of the plated film was quantified by ICP emission analysis. The crystallization temperature was defined as the temperature of the thermal peak of crystallization as determined by differential thermal analysis (DTA).

The magnetic property of saturation flux density was read from the B–H curve obtained using a vibrating specimen magnetometer (VSM). Determination of the film-forming properties of the plated film was made based on visual observation of the metallic luster of the surface and the thin-film formability, and on the releasability from the electrode. Unreleasable films were chipped off from the electrode and subjected to the above described analysis.

The results are given in Table 1.

Comparison 1

Mixed solutions with concentrations of 0.1 mol/l ferrous chloride and 0.9 mol/l cobalt sulfate were adjusted to pH 1.0 using hydrochloric acid and sulfuric acid, respectively. To 500 cc of each solution there was added 50 cc of a 0.5 mol/l sodium tungstate solution, and the mixture was stirred and allowed to stand, after which the condition thereof was visually observed as in Example 1.

The result was that a white precipitate was produced directly after addition of the sodium tungstate solution, and it disappeared upon stirring. A dark yellow precipitate was produced thereafter, with no change even after long-term storage.

These results from Example 1 and Comparison 1 are believed to be due to precipitation of the white precipitates of iron hydroxide and cobalt hydroxide which were produced directly after the addition of the alkaline solution of sodium tungstate, whereas the solution was made uniform in every portion by the subsequent stirring, which returned the entire solution to acidity and thus caused dissolution of the hydroxides. After the solutions were allowed to stand, it is believed that the specimens in Comparison 1 which were adjusted with hydrochloric acid and sulfuric acid produced precipitates of tungstic acid.

Example 2

A mixed aqueous solution with concentrations of 0.05 mol/l ferrous chloride, 0.45 mol/l cobalt sulfate and 0.02 mol/l sodium phosphotungstate was adjusted to pH 1.6 using a 1.0 mol/l phosphorous acid solution. The solution was completely stable, with no production of precipitates, etc. Plating was performed under the same electrolysis conditions as in Example 1, using this solution as the electrolyte solution. The analysis of the plated film was carried out in the same manner as in Example 1, and the results are given in Table 1.

Comparison 2

A mixed solution with concentrations of 0.05 mol/l ferrous chloride, 0.45 mol/l cobalt sulfate and 0.015 mol/l sodium phosphotungstate was adjusted to pH 1.5 using a 1.0 mol/l phosphorous acid solution. Electrolysis was performed in the same manner as in Example 1, and the results of analysis of the obtained film are given in Table 1.

Comparison 3

A mixed solution with concentrations of 0.01 mol/l ferrous chloride, 0.09 mol/l cobalt sulfate and 0.03 mol/l sodium phosphotungstate was adjusted to pH 1.8 using a 1.0 mol/l phosphorous acid solution. Plating was performed under the same electrolysis conditions as in Example 1, but with a current density of 3 A/dm$^2$. The plating film was also analyzed in the same manner as described above, and the results are given in Table 1.

TABLE 1

| | Amorphism | Crystallization temperature | Saturation flux density | Plated film formability |
|---|---|---|---|---|
| Example 1 $Fe_{5.4}Co_{84.0}P_{9.2}W_{1.4}$ | O | 600° C. | 1.25 T | O |
| Example 2 $Fe_{2.8}CO_{80.7}P_{16.0}W_{0.5}$ | O | 600° C. | 1.20 T | O |
| Comparison 2 $Fe_{3.5}Co_{79.1}P_{17.2}W_{0.2}$ | O | 350° C., 600° C. | 0.95 T | O |
| Comparison 3 $Fe_{4.1}Co_{87.4}P_{3.0}W_{5.5}$ | X | — | — | X |

Amorphism: X-ray diffraction; amorphous = O, crystalline = X
Crystallization temperature: DTA; thermal peak temperatures shown in DTA chart in FIG. 1
Saturation flux density: VSM
Plated film formability: Visual; satisfactory plating = O, fragile with no surface blush peeling = X The results given above show that when the phosphorus content exceeds 16 at % (x>0.16), the crystallization temperature is as low as 350° C., and the saturation flux density is also low. Conversely, crystallinity resulted with a phosphorus content of less than 4 at % (x<0.04). Likewise, the crystallization temperature was low with a tungsten content of less than 0.5 at % (y<0.005), and at greater than 5 at % (y>0.05), the plated film formability was poor, and no thin film was produced.

Comparison 4

A mixed aqueous solution with concentrations of 0.1 mol/l ferrous chloride, 0.45 mol/l cobalt sulfate, 0.1 mol/l phosphorous acid and 0.05 mol/l sodium tungstate was adjusted to pH 1.8 using a 1.0 mol/l phosphorous acid solution, and plating was performed for 6 minutes in the same manner as in Example 1.

This specimen was cut into a 5 mm-wide tape, and on one side thereof was applied alumina powder (particle size=1 μm) dispersed in an organic solvent. The resulting magnetic thin film was wound on a silica tube having a outer diameter of 15 mm, a length of 5 mm and a thickness of 1 mm, and the specimen was prepared upon heating at a temperature of 350° C. A 0.5 mm diameter enamel wire was wound 15 turns around the silica tube.

A Yokogawa-Packard (K.K.) 4275A Multi Frequency LCR meter was used to measure the inductance, and the initial permeability was determined according to the following equation. The measurement was at a frequency of 10 MHz and a magnetizing current of 0.75 mA (with 3 mOe).

$$\mu=(L\bullet l\bullet 10^9)/4\pi n^2 S$$

Here, L is inductance (H), ω is 2πf (f: frequency), I is the average magnetic path length (cm), n is the number of winding turns, and S is the gross area of the magnetic film (cm$^2$).

The composition, atomic ratio of iron and cobalt (a=Co/(Co+Fe)) and the initial permeability are shown in Table 2. The initial permeability for Example 1 was also determined in the same manner.

TABLE 2

| Composition | a | Initial permeability |
|---|---|---|
| Comparison 4 $Fe_{11.5}Co_{77.0}P_{10.5}W_{1.0}$ | 0.87 | 700 |
| Example 1 $Fe_{5.4}Co_{84.0}P_{9.2}W_{1.4}$ | 0.94 | 1,150 |

Specimens with "a"values of 0.9 or greater have a higher initial permeability.

Example 3

A mixed solution with concentrations of 0.05 mol/l ferrous chloride, 0.45 mol/l cobalt sulfate, 0.05 mol/l of nickel sulfate and 0.02 mol/l sodium phosphotungstate was adjusted to pH 1.5 with a phosphorous acid solution. Plating was performed for 6 minutes in the same manner as in Example 1, and the initial permeability was measured as in Comparison 4. The results are given in Table 3. Excellent magnetic properties were exhibited.

TABLE 3

| Composition | a | Initial permeability |
|---|---|---|
| $Fe_{3.5}Co_{78.9}P_{9.9}W_{0.7}Ni_{7.0}$ | 0.96 | 900 |

Example 4

To a mixed solution with concentrations of 0.1 mol/l ferrous chloride, 0.9 mol/l cobalt sulfate and 0.1 mol/l phosphorous acid was slowly added while stirring sodium tungstate to a concentration of 0.07 mol/l. A 1.0 mol/l phosphorous acid solution was used to adjust the solution to pH 1.6. Plating was performed with the same electrolysis conditions as in Example 1, to obtain an amorphous alloy with a film thickness of 1.5 μm and having a composition in terms of atomic ratio of Fe/Co/P/W=4.6/84.5/8.2/2.7

This specimen was cut into a 5 mm-wide tape, and on one side thereof was applied alumina powder (particle size=1 μm) dispersed in an organic solvent. The film was wound on a silica tube having a outer diameter of 15 mm, a width of 5 mm and a thickness of 1 mm, and the specimen was heat tested at 500° C. for one hour. The values of the initial permeabilities of this specimen and the specimen obtained in Comparison 2 which was heat-treated at 500° C. for one hour are given in Table 4.

TABLE 4

| | | Comparison 2 | Example 4 |
|---|---|---|---|
| Measurement of initial permeability | untreated | 450 | 420 |
| | 500° C. × 1 hr | 170 | 1060 |

We claim:

1. A method for producing an amorphous alloy characterized by electrodepositing an amorphous alloy in which at least the atomic ratio of iron and cobalt is 90% or more of cobalt, the phosphorus content is 4–16 atomic % and the tungsten content is 0.5–5 atomic %, said method using an electrolyte bath containing;

divalent iron ion 0.01–0.2 mol/l divalent cobalt ion 0.1–2.0 mol/l phosphite ion 0.01–0.2 mol/l tungstate ion or phosphotungstate ion 0.005–0.1 mol/l and the electrodepositing is performed at pH 1.0–2.2 current density 1–40 A/dm$^2$ bath temperature 20°–80° C.

2. A method for producing an amorphous alloy according to claim 1, wherein said alloy has an alloy composition represented, in terms of atomic ratio by the following general formula:

$$(Fe_{1-a}\ Co_a)_{1-x-y-z}\ P_x\ W_y\ M_z$$

where $0.9 \leqq a$ $0.04 \leqq x \leqq 0.16$ $0.005 \leqq y \leqq 0.05$ $0 \leqq z \leqq 0.2$ and M is one or more transition elements other than Fe, Co, and W.

* * * * *

UNITED STATES PATENT AND TRADEMARK OFFICE

CERTIFICATE OF CORRECTION

PATENT NO. : 5,484,494

DATED : January 16, 1996

INVENTOR(S) : Masaharu ODA et al.

It is certified that error appears in the above-indentified patent and that said Letters Patent is hereby corrected as shown below:

On the title page, the PCT information has been omitted from the Letters Patent. These include Items: [22], [86], and [87]. The information should read as follows:

--[22] PCT Filed: Jan. 29, 1993

[86] PCT No. PCT/JP93/00108

§ 371 Date: Nov. 14, 1994
§ 102(e) Date: Nov. 14, 1994

[87] PCT Pub. No.: WO93/23583

PCT Pub. Date: Nov. 25, 1993--

Signed and Sealed this

Fourteenth Day of May, 1996

*Attest:*

Bruce Lehman

BRUCE LEHMAN

*Attesting Officer*

*Commissioner of Patents and Trademarks*